US005517714A

United States Patent [19]

Kotitschke

[11] Patent Number: 5,517,714

[45] Date of Patent: May 21, 1996

[54] DEVICE FOR CLEANING A CIRCULATING SCREEN

[75] Inventor: Gerhard Kotitschke, Steinheim, Germany

[73] Assignee: J. M. Voith GmbH, Germany

[21] Appl. No.: 290,472

[22] Filed: Aug. 15, 1994

[30] Foreign Application Priority Data

Aug. 17, 1993 [DE] Germany ..... 43 27 601.6

[51] Int. Cl.[6] ..... B08B 5/02

[52] U.S. Cl. ..... 15/309.1; 134/122 R; 134/64 R; 162/275

[58] Field of Search ..... 134/64 R, 122 R, 134/102.3, 199, 104.1; 15/309.1; 198/495; 162/274, 275

[56] References Cited

U.S. PATENT DOCUMENTS

| | | | |
|---|---|---|---|
| 1,120,840 | 12/1914 | Niles | 15/309.1 X |
| 2,472,596 | 6/1949 | Kunz | 15/309.1 X |
| 3,298,904 | 1/1967 | Le Compte, Jr. | 134/122 R X |
| 4,154,648 | 5/1979 | Osterberg et al. | 162/275 X |
| 4,643,775 | 2/1987 | Reba et al. | 15/309.1 X |
| 4,698,134 | 10/1987 | Green et al. | 162/275 X |
| 4,842,000 | 6/1989 | Malashenko | 134/64 R |

FOREIGN PATENT DOCUMENTS

| | | | |
|---|---|---|---|
| 116501 | 9/1929 | Austria | 162/275 |
| 106201 | 3/1898 | Germany . | |
| 4018074 | 12/1991 | Germany . | |
| 4101350 | 7/1992 | Germany . | |
| 9213132 | 8/1992 | Germany . | |
| 430700 | 6/1935 | United Kingdom | 162/274 |
| 1018367 | 10/1964 | United Kingdom . | |
| 2061341 | 5/1981 | United Kingdom | 162/274 |

*Primary Examiner*—Frankie L. Stinson
*Attorney, Agent, or Firm*—Ostrolenk, Faber, Gerb & Soffen

[57] ABSTRACT

The device comprises a blowing device (2) extending transversely to the screen travel direction, said device having two mutually parallel strips extending transversely to the travel direction of the screen, namely a leading strip (41) and a trailing strip (42), each of which contacts circulating screen (11) with a screen guide surface. Between the two strips is a blowing opening connected to a source of compressed air (62). Between leading strip (41) and screen (11) a wedge-shaped gap (45) is formed, tapering in the screen travel direction, in which gap a water-spraying device (3) terminates. Blowing device (2) is located inside the endless loop of screen (11), and water-spraying device (3) is located on the outside.

8 Claims, 1 Drawing Sheet

DEVICE FOR CLEANING A CIRCULATING SCREEN

BACKGROUND OF THE INVENTION

The present invention relates to a device for cleaning a circulating screen serving to form a fiber web (e.g., a paper web). The invention takes its departure from the subject of WO 92/13132.

As is known, a paper-making machine has an endlessly circulating screen serving to dewater a fiber suspension in order to form a paper web therefrom. This web is then removed from the screen and fed to subsequent processing stations (a pressing and a drying part, for example). The endless screen then returns to the point where the fiber suspension is added. During this return run, the screen must be cleaned; in particular, adhering fibers and filler particles must be removed.

The cleaning device suitable for this purpose and described in WO' 132 essentially comprises a blowing device extending transversely with respect to the screen travel direction, said device forming a gap relative to the screen travel direction with the screen in front of a blowing opening, said gap tapering in the manner of a wedge. A water spray device terminates in this gap. Thus, a film of water is formed on one side of the screen, onto which the air stream (emerging from the blowing opening) impinges. The air stream thus forces the water through the screen mesh, loosening and carrying away dirt particles from the screen. It is also known that a screen-cleaning device of this kind can be used when the paper web formed on the screen is removed from the screen during normal operation, but in this device, however, the web is released from the screen during the starting phase by means of the cleaning device and must be guided into a waste separator. The use of such a screen-cleaning device in a double screen section is also known, in which the initial web formation takes place between two screens. In this case a screen-cleaning device can be provided in the return run of each of the two screens.

SUMMARY OF THE INVENTION

The object of the present invention is to improve further the screen-cleaning device known from WO' 132 and/or to ensure that it is even more universally applicable than before.

According to a first aspect of the invention, this goal is achieved by virtue of the fact that the blowing device is located on one side of the screen and the water spraying device is located on the other side of the screen. According to the invention therefore the water supplied is not conveyed directly into the convergent gap, but through the screen. Then the water is immediately forced again for a second time through the screen in the opposite direction by means of the abovementioned stream of blown air. This produces a two-stage cleaning of the screen and therefore a cleaning effect that is an improvement over those known previously; the same water is pumped twice through the screen.

Because the formation of the paper web on the endless screen naturally always takes place on its outer side, when the screen makes its return run the fibers that adhere likewise are found, at least predominantly, on the exterior of the screen. For this reason, advantageously, the blowing device is located inside the endless loop of the screen, but the water spraying device is located outside. In particular, with this arrangement the cleaning device according to the invention has the following additional advantage: the water spraying device can be supplied with waste water from the paper-making machine, which is not 100% clean but still contains fibers. These fibers are then retained by the exterior of the screen when the waste water is sprayed onto said screen, and then removed from the screen by the blast of air. In other words, these fibers do not interfere with the screen-cleaning process.

According to another aspect of the invention, the air blast stream is not aimed directly at the screen to be cleaned, but at the circumference of a screen guide roller, specifically a short distance before the screen passes over this roller. Accordingly, the two strips between which the blower opening is located (relative to the roller rotation direction) are arranged sequentially on the circumference of the screen guide roller, specifically first a so-called first strip and then (in other words, behind the blowing opening) a so-called second strip, which (viewed in cross section) extends in the direction of the point where the screen runs onto the screen guide roller. Preferably the second strip contacts the screen at this point. The first strip can form a sealing gap with the jacket of the screen guide roller. In any event, a narrow gap is located between the strips and the jacket of the screen guide roller, said gap connecting the blowing opening directly with the screen. The gap tapering in the screen travel direction, in which the water spraying device terminates, likewise extends in the direction of the point where the screen runs onto the screen guide roller. Thus, a film of water travels up to this point and there, together with the supplied air and with the aid of the rotating screen guide roller, is forced through the screen. This produces an improved cleaning effect as well. This arrangement is especially suitable for the part of the screen where the entire web is removed from the screen during the starting phase and must be conducted into a waste separator. In this case the blowing device and the water spraying device are both located inside the endless screen loop. when this arrangement is used at another point on the screen, however, the water spraying device can also be located on the outside of the screen.

Other features and advantages of the present invention will become apparent from the following description of the invention which refers to the accompanying drawings.

BRIEF DESCRIPTION OF THE DRAWING(S)

The drawing shows a double-screen part in a schematic side view.

DETAILED DESCRIPTION OF A PREFERRED EMBODIMENT OF THE INVENTION

Figure 1:
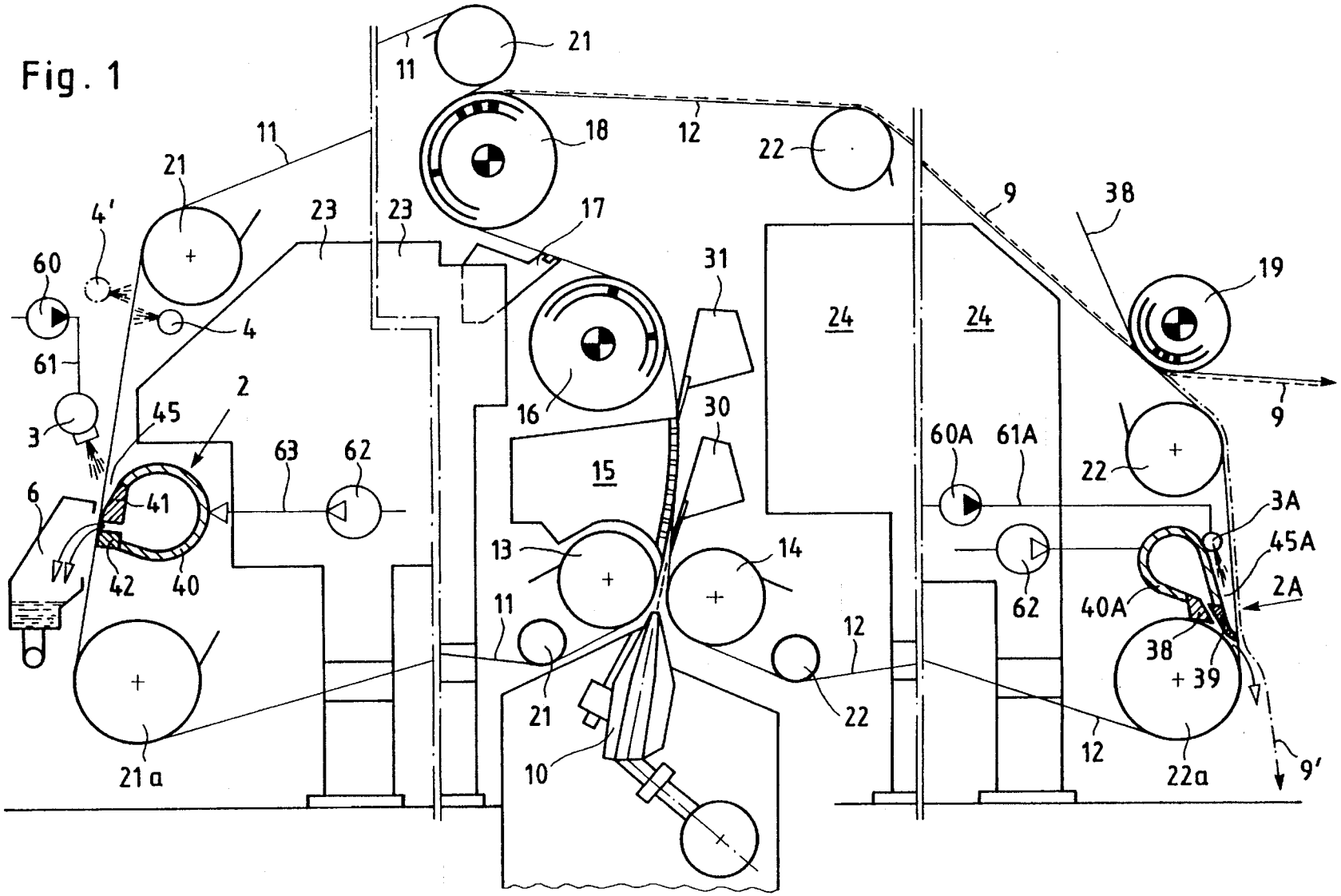

The drawing shows a head box 10 and two endless screen belts, namely a first screen 11 and a second screen 12, each of which is guided into a double-screen zone by a breast roll 13 or 14. In the double-screen zone the two screens 11 and 12 initially pass over a curved stationary supporting device 15 and immediately thereafter over a dewatering roller 16. These two elements 15 and 16 as well as an additional stationary supporting device, designed as suction box 17 for example, are all located inside the loop of the first screen 11. Then the two screens pass over a screen suction roller 18 located in the loop of second screen 12. In the vicinity of the upper vertex of this roller 18, the two screens 11 and 12 separate, with the paper web being removed from second screen 12 to a removing suction roller 19. The other guide rollers still available for the first screen are labeled 21 and **21*a* and the guide rollers for the second screen are labeled 22 and 22*a*. Finally in FIG. 1 a machine frame 23 for the first screen and a machine frame 24 for the second screen are shown. To strip away the water forced through the mesh of second screen 12, deflectors 30, 31** are used.

The double-screen former is shown in a preferred design in which the outward flow direction of material from the head box 10 and the travel direction of screens 11 and 12 in the initial area of the double-screen zone run approximately vertically from bottom to top. Other arrangements are also possible however.

A screen-cleaning device is provided on screen 11, above screen guide roller 21*a*, returning from top to bottom. This device comprises an air-blowing device generally designated 2, preferably located inside the loop of first screen 11, as well as a water spraying device 3 located on the other side of screen 11, in other words preferably on the exterior. Below the water spraying device a collecting tank 6 is provided which serves to carry away the water enriched with the impurities.

Air-blowing device 2 is designed for high air pressure. It comprises a pressure tube 40, a leading strip 41 and a trailing strip 42. These two strips which contact the circulating screen 11 delimit between them a blowing opening that extends transversely with respect to the screen travel direction or a plurality of blowing openings that form a row. An air pump 62 delivers air through line 63 at high pressure into the interior of pressure tube 40. From here the air travels at high speed through the blowing opening and through the mesh of screen 11 into collecting container 6. Leading strip 41 together with screen 11 forms a gap 45 that is wedge-shaped and tapers in the direction of travel of the screen (in other words, a convergent gap). The streams of water coming from water spraying device 3 pass through screen 11 into the above-mentioned gap 45 and from there together with the air and the impurities loosened from the screen, into collecting container 6. A water pump 60 delivers water through a line 61 into water spraying device 3, preferably designed as a spray tube with flat spray nozzles. Above water spraying device 3, a high-pressure spray tube can also be provided, preferably inside screen 11; however a system as shown at 4', located on the outside of the screen, can also be used. High-pressure spray tube 4 preferably has needle nozzles and is coupled with a traveler to avoid the formation of stripes on the screen; alternatively, it can also be equipped with flat stream nozzles.

The paper web 9 that is formed (indicated by a dashed line), travels, as already mentioned, together with screen 12 up to a removal suction roller 19 where, in normal operation, it is taken over by a removing felt 38 and transported further. During the starting phase or during a malfunction, removal suction roller 19 is lifted in known fashion from screen 12. In this operating state, the web, as indicated by dot-dashed line 9', travels together with screen 12 up to the lowermost screen guide roller 22*a*. Here the web is "beaten off" screen 12 by means of another screen-cleaning device. This screen-cleaning device also comprises a blowing device 2A extending transversely with respect to the screen travel direction and a water spraying device 3A, both of which are located inside the loop of second screen 12. Blowing device 2A in turn is composed of a pressure tube 40A and of two strips extending transversely with respect to the travel direction of screen 12, namely a first strip 38 and a second strip 39. In contrast to blowing device 2 described above, these two strips 38 and 39 are arranged sequentially on the circumference of screen guide roller 22*a*. Viewed in cross section, second strip 39 extends in the direction of the point where screen 12 runs onto roller 22*a*. The two strips 38 and 39 in turn delimit a blowing opening and, together with the jacket of screen guide roller 22*a*, form a narrow gap in which the blowing opening terminates. Second strip 39 can gently contact the inside of screen 12 so that the above-mentioned narrow gap terminates directly at the screen. Thus, the compressed air fed into pressure tube 40A passes through the blowing opening and through the above-mentioned narrow gap into screen 12 and is forced through screen 12 with the aid of the rotation of roller 22*a*. The water coming off water spraying device 3A passes from above into a gap 45A which tapers downward, said gap being located between blowing device 2A and screen 12. Water pump 60A feeds water spraying device 3A through line 61A with fiber-free water. This water, guided into gap 45A in the manner described, increases the cleaning action of blowing device 2A considerably. The latter is therefore able to "beat" the entire paper web 9' off screen 12 if necessary.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A device for cleaning a screen used to form a fiber web, the screen having first and second opposed sides and travelling in an endless loop in a predetermined direction, which device comprises:

(a) a blowing device located adjacent the first side of the screen and extending transversely of the direction of travel of the screen, the blowing device having two parallel, spaced strips, each of which contacts the screen and between which an opening is formed; one of said strips being located in a leading direction relative to a direction of travel of the screen and the other of the strips being located in a trailing direction, the leading strip being angled in the direction of travel of the screen to form a wedged shaped gap tapering in the direction of travel of the screen;

(b) means for connecting the blowing device to a source of compressed air so that a stream of compressed air is directed through the opening onto the first side of the screen; and (c) water spray means mounted adjacent the second side of the screen for directing a stream of water through the screen into the wedged shaped gap, the blowing device being located immediately following the water spray means as viewed in the direction of travel of the screen.

2. A device according to claim 1, wherein the blowing device is located inside the endless loop of the screen and the water spraying means is located outside the endless loop of the screen.

3. A device according to claim 1, further including a high-pressure spray tube located upstream of the water spraying means for directing a high pressure stream of water at the screen.

4. A device for cleaning a screen used to form a fiber web, the screen travelling in an endless loop in a predetermined direction, which device comprises:

(a) a roller over which the screen travels such that a first wedge shaped gap is formed between the screen and the roller;

(b) a blowing device located within the first wedge shaped gap and extending transversely of the direction of travel of the screen, the blowing device having two parallel, spaced strips, each of which contacts the screen and between which an opening is formed, the opening terminating such as to form a gap between the termination of the opening and the screen; one of said strips being located in a leading direction relative to the direction of rotation of the roller and the other of the strips being located in a trailing direction relative to the direction of rotation of the roller, the leading strip being angled in the direction of travel of the screen to form a second wedged shaped gap tapering in the direction of travel of the screen;

(c) means for connecting the blowing device to a source of compressed air so that a stream of compressed air is directed through the opening onto the first side of the screen; and (d) water spray means mounted within the second wedge shaped gap for directing a stream of water onto the screen.

5. A device according to claim 4, wherein the leading strip forms a sealing gap with the roller.

6. A device for cleaning a screen used to form a fiber web, the screen travelling in an endless loop in a predetermined direction, which device comprises:

(a) a roller over which the screen travels such that a first wedge shaped gap is formed between the screen and the roller;

(b) a blowing device located within the first wedge shaped gap and extending transversely of the direction of travel of the screen, the blowing device having two parallel, spaced strips, each of which contacts the screen and between which an opening is formed, the opening terminating such as to form a gap between the termination of the opening and the screen; one of said strips being located in a leading direction relative to the direction of rotation of the roller and the other of the strips being located in a trailing direction relative to the direction of rotation of the roller, the leading strip being angled in the direction of travel of the screen to form a second wedged shaped gap tapering in the direction of travel of the screen; wherein the two strips are arranged sequentially about the circumference of the roller with the trailing strip extending in the direction of the point at which the screen travels over the roller;

(c) means for connecting the blowing device to a source of compressed air so that a stream of compressed air is directed through the opening onto the first side of the screen; and (d) water spray means mounted within the second wedge shaped gap for directing a stream of water onto the screen.

7. A device according to claim 6, wherein the leading strip contacts the screen.

8. A device according to claim 7, further including a high-pressure spray tube located upstream of the water spraying means for directing a high pressure stream of water at the screen.

* * * * *